US007076192B2

(12) United States Patent
Tsuda et al.

(10) Patent No.: US 7,076,192 B2
(45) Date of Patent: Jul. 11, 2006

(54) POWDER CONVEYING DEVICE AND IMAGE FORMING APPARATUS USING THE SAME

(75) Inventors: Kiyonori Tsuda, Kanagawa (JP); Hiroshi Hosokawa, Kanagawa (JP); Satoshi Narumi, Kanagawa (JP); Yuji Arai, Kanagawa (JP); Ryuta Takeichi, Kanagawa (JP); Masanori Kawasumi, Kanagawa (JP); Kazuhiko Umemura, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 87 days.

(21) Appl. No.: 10/742,835

(22) Filed: Dec. 23, 2003

(65) Prior Publication Data

US 2004/0184841 A1 Sep. 23, 2004

(30) Foreign Application Priority Data

Dec. 27, 2002 (JP) ..... 2002-380800

(51) Int. Cl.
*G03G 15/08* (2006.01)

(52) U.S. Cl. ..... 399/258; 222/DIG. 1; 399/262

(58) Field of Classification Search ..... 399/258, 399/262, 252; 222/DIG. 1, 167
See application file for complete search history.

(56) References Cited

U.S. PATENT DOCUMENTS

| | | | | |
|---|---|---|---|---|
| 5,444,515 | A * | 8/1995 | Haneda et al. | 399/112 |
| 5,499,090 | A * | 3/1996 | Ito et al. | 399/359 |
| 5,640,644 | A * | 6/1997 | Kimura et al. | 399/262 X |
| 6,198,895 | B1 | 3/2001 | Tsuda et al. | 399/267 |
| 6,337,957 | B1 | 1/2002 | Tamaki et al. | 399/29 |
| 6,447,973 | B1 | 9/2002 | Asami et al. | 430/114 |
| 6,493,529 | B1 | 12/2002 | Umemura et al. | 399/168 |
| 6,521,386 | B1 | 2/2003 | Sakon et al. | 430/58.15 |
| 6,522,855 | B1 | 2/2003 | Katoh et al. | 399/274 |
| 6,558,862 | B1 | 5/2003 | Kojima et al. | 430/58.05 |
| 6,560,431 | B1 | 5/2003 | Hosokawa | 399/258 |
| 6,562,529 | B1 | 5/2003 | Kojima et al. | 430/56 |
| 6,615,013 | B1 | 9/2003 | Arai et al. | 399/253 |
| 6,697,595 | B1 | 2/2004 | Kawagoe et al. | 399/302 |
| 6,706,459 | B1 | 3/2004 | Kojima et al. | 430/124 |
| 2002/0044791 | A1 * | 4/2002 | Shinkai et al. | 399/112 |
| 2003/0235436 | A1 * | 12/2003 | Kasahara et al. | 399/258 |

FOREIGN PATENT DOCUMENTS

| | | | |
|---|---|---|---|
| EP | 0 195 528 | A1 * | 9/1986 |
| JP | 62-228419 | A * | 10/1987 |
| JP | 8-30097 | | 2/1996 |
| JP | 8-335024 | | 12/1996 |
| JP | 10-133464 | | 5/1998 |

(Continued)

OTHER PUBLICATIONS

U.S. Appl. No. 11/226,197, filed Sep. 15, 2005, Kimura et al.

(Continued)

*Primary Examiner*—Sophia S. Chen
(74) *Attorney, Agent, or Firm*—Oblon, Spivak, McClelland, Maier & Neustadt, P.C.

(57) ABSTRACT

A powder conveying device of the present invention includes a powder storing portion storing powder, and a pipe configured to guide the powder from the powder storing portion to a destination positioned below the powder storing portion. The pipe extends downward from the powder storing portion toward the destination, then bends with an inclination angle smaller than the preceding inclination angle relative to the horizontal, and then connects to the destination.

16 Claims, 17 Drawing Sheets

FOREIGN PATENT DOCUMENTS

| | | | |
|---|---|---|---|
| JP | 10-239969 | | 9/1998 |
| JP | 10-239974 | | 9/1998 |
| JP | 10-268725 A | * | 10/1998 |
| JP | 11-084971 A | * | 3/1999 |
| JP | 11-231631 | | 8/1999 |
| JP | 11-242418 A | * | 9/1999 |
| JP | 2001-194860 A | * | 7/2001 |
| JP | 2003-029514 A | * | 1/2003 |

OTHER PUBLICATIONS

U.S. Appl. No. 11/287,305, filed Nov. 28, 2005, Hosokawa et al.

* cited by examiner

POWDER CONVEYING DEVICE AND IMAGE FORMING APPARATUS USING THE SAME

BACKGROUND OF THE INVENTION

1. Field of the Invention

The present invention relates to a powder conveying device for conveying toner or similar powder from a powder storing portion to a destination positioned below the powder storing portion via a pipe, and an image forming apparatus using the same.

2. Description of the Prior Art

It is a common practice with a copier, facsimile apparatus, printer or similar image forming apparatus to use a toner conveying device. The toner conveying device includes toner discharging means for discharging toner from a toner container and a pipe connecting the toner container to a developing device configured to develop a latent image formed on a photoconductive drum or similar image carrier with the toner. The toner discharging means is operated to discharge the toner from the toner container to the pipe for thereby directly conveying the toner to the developing device, as needed. If the toner container is positioned at a lower level or height than the developing device, then the toner or powder, introduced into the pipe must be lifted toward the developing device against gravity, resulting in low conveying efficiency and the stop-up of the pipe In light of the above, the toner container is usually positioned at a higher level than the developing device such that the toner is conveyed in the direction of gravity. Japanese Patent Laid-Open Publication No. 8-30097, for example, discloses a toner conveying device configured to causes toner, which is discharged from a toner box or toner container to a pipe by toner discharging means, to drop into a developing device due to its own weight.

However, the toner conveying device taught in the above document has a problem that when the toner, introduced into the pipe, accumulates on the inner wall of the pipe in a certain amount, the toner is apt to rush into the developing device at a time. In a developing system using a two-component type developer, i.e., a toner and magnetic carrier mixture, the toner rushed into the developing device makes it difficult to accurately control the toner content of the developer. On the other hand, in a developing system using a single-component type developer, i.e., toner, the above toner causes the ratio of toner not sufficiently charged to sharply increase in the developing device, resulting in background contamination. If the toner box and developing device are positioned close to each other in order to reduce the length of the pipe as far as possible, then the toner can be prevented from accumulating in the pipe and rushing into the developing device. This, however, obstructs the free layout of various devices in the image forming apparatus.

An arrangement may be made such that the toner discharged from the toner container does not drop from the pipe due to its own weight, but stays in the pipe while being conveyed toward the developing device in an amount controllable on the basis of the amount of drive of a conveying member disposed in the pipe. Such an arrangement still has a problem that when some impact acts on the pipe, the toner in the pipe is apt to rush into the developing device at a time even when the conveying member is not driven.

The problems described above in relation to toner are also apt to arise in any other powder conveying device dealing with powder other than toner.

Technologies relating to the present invention are also disclosed in, e.g., Japanese Patent Laid-Open Publication Nos. 8-335024, 10-133464, 10-239969, 10-239974 and 11-231631.

SUMMARY OF THE INVENTION

It is an object of the present invention to provide a powder conveying device capable of solving the problems ascribable to the conveyance of powder effected against gravity, and an image forming apparatus using the same.

It is another object of the present invention to provide a powder conveying device capable of solving, without obstructing the free layout of a powder container and a destination, the problems ascribable to the rushing of the powder from a pipe into a destination, and an image forming apparatus using the same.

A powder conveying device of the present invention includes a powder storing portion storing powder, and a pipe configured to guide the powder from the powder storing portion to a destination positioned below the powder storing portion. The pipe extends downward from the powder storing portion toward the destination, then bends with an inclination angle smaller than the preceding inclination angle relative to the horizontal, and then connects to the destination.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
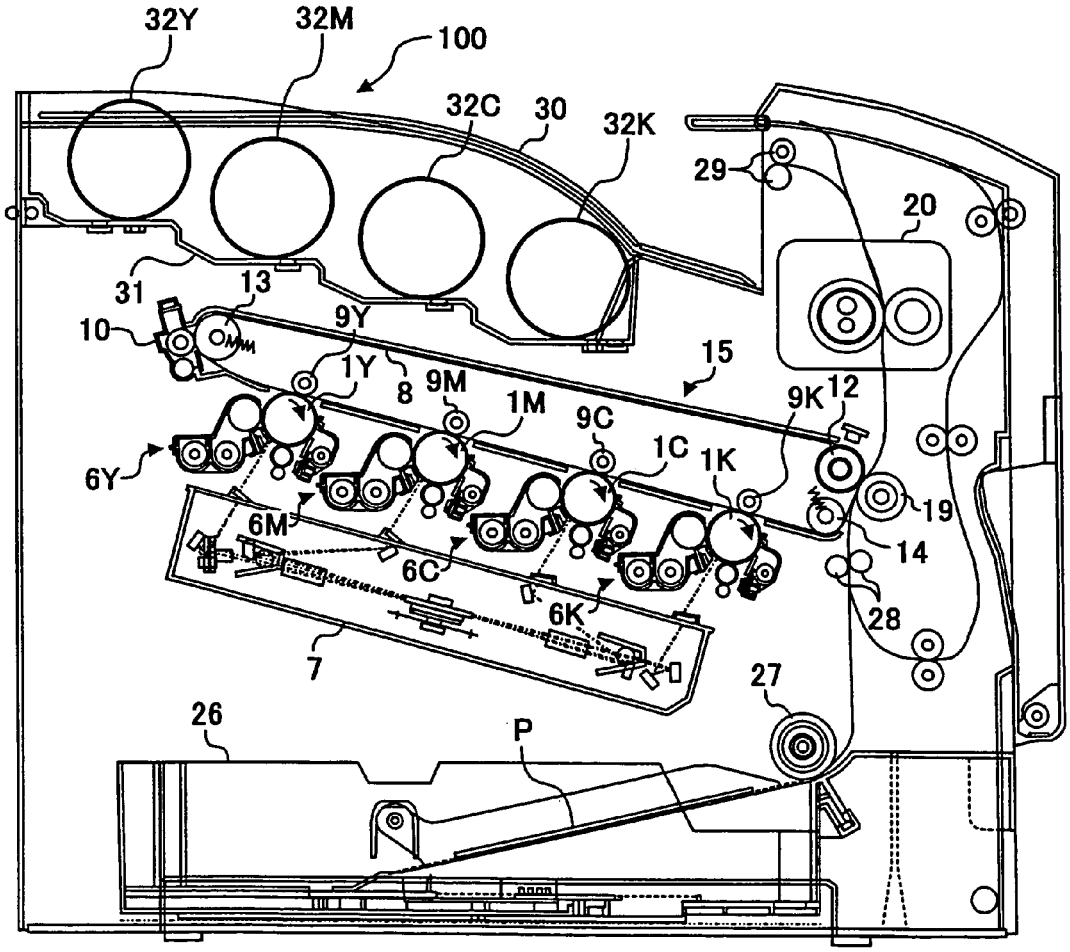
FIG. 1 is a view showing the general construction of an image forming apparatus embodying the present invention.
Figure 2:
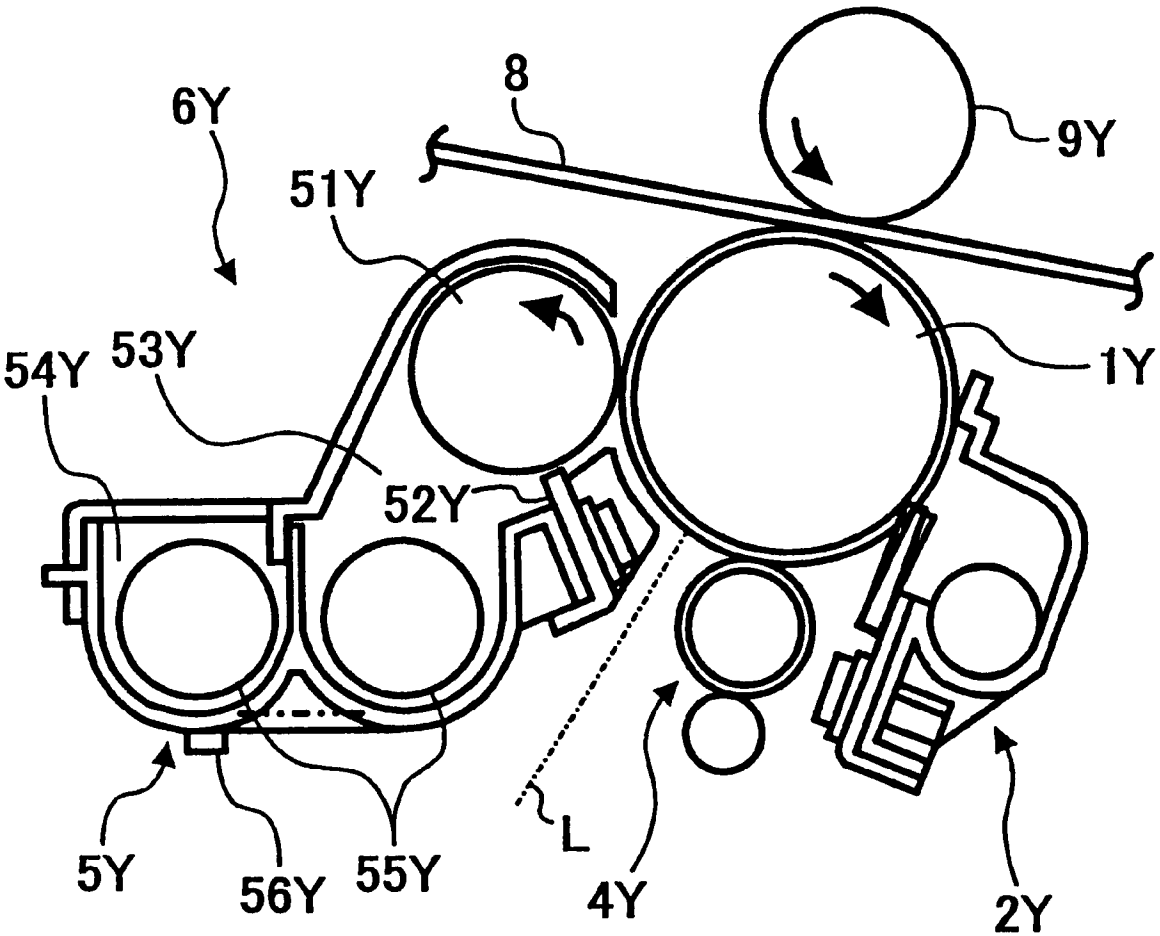
FIG. 2 is an enlarged view showing a process cartridge included in the illustrative embodiment together with members arranged therearound.

Referring to FIG. 1 of the drawings, an image forming apparatus embodying the present invention is shown and implemented as an electrophotographic printer by way of example. As shown, the printer, generally 100, includes four process cartridges 6Y (yellow), 6M (magenta), 6C (cyan) and 6K (black) identical in configuration except for the color of toner to use and each being replaceable when the life ends. FIG. 2 shows the process cartridge 6Y in detail by way of example. As shown, the process cartridge 6Y includes a photoconductive drum or image carrier 1Y, a drum cleaner 2Y, a discharger, not shown, a charger 4Y, and a developing device 5Y. The process cartridge 6Y is removably mounted to the printer 100 and allows its expendables to be replaced at a time.

The charger 4Y uniformly charges the surface of the drum 1Y being rotated clockwise, as viewed in FIG. 2, by drive means not shown. A laser beam L scans the thus charged surface of the drum 1Y in accordance with Y image data to thereby form a latent image. Subsequently, the developing device 5Y develops the latent image with Y toner to thereby produce a Y toner image. The Y toner image is then transferred from the drum 1Y to an intermediate image transfer belt (simply belt hereinafter) 8. The drum cleaner 2Y removes the Y toner left on the drum 1Y after such image transfer. Subsequently, the discharger discharges the surface of the drum 1Y to thereby prepare the drum 1Y for the next image formation. An M, a C and a K toner image are respectively formed by the other process cartridges 6M, 6C and 6K in the same manner as the Y toner image and transferred to the belt 8 one above the other, completing a full-color image.

The developing device 5Y includes a sleeve or developer carrier 51Y partly exposed to the outside via an opening formed in a casing, two screws 55Y-1 and 55Y-2 parallel to each other, a doctor blade 52Y, and a toner content sensor 56Y. A Y developer is stored in the casing and made up of magnetic carrier grains and Y toner grains. The Y developer is conveyed by the screws 55Y-1 and 55Y-2 while being frictionally charged and is then deposited on the surface of the sleeve 51Y, forming a developer layer. The developer layer is conveyed to a developing zone where the sleeve 51Y faces the Y photoconductive drum or image carrier 1Y while being regulated in thickness by the doctor blade 52Y. In the developing zone, the toner grains are transferred from the sleeve 51Y to a latent image formed on the drum 1Y, producing a corresponding Y toner image. The Y developer thus released the toner grains is returned on the casing in accordance with the rotation of the sleeve 51Y.

A partition is positioned between the screws 55Y-1 and 55Y-2 and divides the casing into a first developer storing portion 53Y accommodating the sleeve 51Y and screw 55Y-1 and a second developer storing portion 54Y accommodating the screw 55Y-2. The screw 55Y-1, driven by drive means not shown, rotates to convey the Y developer in the first developer storing portion 53Y from the front to the rear, as seen in the direction perpendicular to the sheet surface of FIG. 2, toward the sleeve 51Y. On reaching the end portion of the first developer storing portion 53Y, the Y developer is introduced into the second developer storing portion 54Y via an opening, not shown, formed in the partition. In the second developer storing chamber 54Y, the screw 55Y-2, driven by drive means not shown, conveys the Y developer in the opposite direction to the screw 55Y-1. On reaching the end portion of the second developer storing portion 54Y, the Y developer is returned to the first developer storing portion 53Y via another opening, not shown, also formed in the partition.

The toner content sensor 56Y, implemented as a permeability sensor, is mounted on the underside of the center portion of the second developer storing portion 54Y and outputs a voltage corresponding to the permeability of the Y developer that moves above the sensor 56Y. Because the permeability of the Y developer or toner and carrier mixture is correlated to a toner content to some extent, the output of the toner content sensor 56Y corresponds to the toner content of the Y developer. The voltage output from the toner content sensor 56Y is sent to a controller, not shown, including a RAM (Random Access Memory). The RAM stores a target value Vtref to which the output voltage of the toner content sensor 46Y should be controlled as well as target values Vtrefs for M, C and K. The target value Vtref for Y is used to control the drive of a Y toner conveying device, which will be described later. More specifically, the controller drives the Y toner conveying device such that the output voltage of the toner content sensor 56Y approaches the target value Vtref, thereby replenishing the Y toner to the second developer storing portion 54Y. As a result, the toner content of the Y developer is confined in a preselected range. This is also true with the other toner conveying devices assigned to M, C and K.

As shown in FIG. 1, an exposing unit 7 is positioned below the process cartridges 6Y through 6K and scans the drums of the process cartridges 6Y through 6K with laser beams L each being modulated in accordance with particular image data, thereby forming latent images on the drums. The exposing unit 7 includes a polygonal mirror driven by a motor to thereby steer the above laser beams L toward the drums via optical lenses and mirrors. The exposing unit 7 constitutes toner image forming means together with the process cartridges.

Sheet feeding means is disposed below the exposing unit 7 and includes a sheet cassette 26, a pickup roller 27, and a registration roller pair 28. The pickup roller 27 rests on top one of sheets or recording media P stacked on the sheet cassette 26. The pickup roller 27 is driven counterclockwise, as viewed in FIG. 1, by drive means not shown, paying out the top sheet P toward the registration roller pair 28. The registration roller pair 28 nips the leading edge of the sheet P and then stops rotating. Subsequently, the registration roller pair 28 again starts rotating at adequate timing to thereby convey the sheet P toward a secondary image transfer nip, which will be described layer. The pickup roller 27 and registration roller pair or timing roller pair 28 constitute conveying means in combination for conveying the sheet P from the sheet cassette or sheet storing means to the secondary image transfer nip.

An intermediate image transferring unit 15 is located above the process cartridges 6Y through 6K and includes four bias rollers 9Y through 9K for primary image transfer, a belt cleaner 10, a backup roller 12 for secondary image transfer, a backup roller 13 for cleaning, a tension roller 14 in addition to the belt 8. The belt 8 is passed over the three rollers 12 through 14 and caused to turn clockwise, as viewed in FIG. 1, by at least one of such rollers. The bias rollers 9Y through 9K, respectively contacting the drums 1Y through 1K via the belt 8, form primary image transfer nips. The bias rollers 9Y through 9K each apply an image transfer bias opposite in polarity to toner, e.g., positive polarity to the inner surface of the loop of the belt 8. The rollers other than the bias rollers 9Y through 9K all are electrically grounded.

When the belt 8 sequentially moves via the consecutive primary image transfer nips, the toner images are sequentially transferred from the drums 1Y through 1K to the belt 8 one above the other, completing a full-color or four-color image.

The backup roller 12 contacts the secondary image transfer roller 19 via the belt 8, forming the secondary image transfer nip mentioned earlier. The full-color toner image formed on the belt 8 is conveyed to the sheet P at the secondary image transfer nip. The belt cleaner 10 removes toner left on the belt 8 after the secondary image transfer.

At the secondary image transfer nip, the sheet P is conveyed away from the registration roller pair 28 by the belt 8 and secondary image transfer roller 19 moving in the same direction, as seen at the position where the belt 8 and roller 19 contact each other. Subsequently, a fixing unit 20 fixes the full-color image on the sheet P with heat and pressure. The sheet or print P is then driven out of the printer body to a stack tray 30 formed on the top of the printer body via an outlet roller pair 29.

Referring again to FIG. 1, a bottle storage 31 is positioned between the intermediate image transferring unit 15 and the stack tray 30 and accommodates toner bottles 32Y through 32K respectively storing Y, M, C and K toners. The toner bottles 32Y through 32K are slightly inclined relative to the horizontal, the levels of the toner bottles 32Y through 32K sequentially increase in this order. Toner conveying devices, which will be described layer, each replenish one of the Y, M, C and K toners from the associated toner bottle to one of the developing devices of the process cartridges 6Y through 6K, as needed. It is to be noted that the toner bottles 32Y through 32K each are removable from the printer 100 independently of the process cartridges 6Y through 6K.

The process cartridges 6Y through 6K each include the respective drum, drum cleaner, quenching device, charger and developing device, which are mounted to the printer body integrally with each other. While such structural elements have traditionally been mounted and dismounted from a printer body as replaceable, expendable supplies, maintenance has been inefficient because it has been difficult for an operator to understand how to mount and dismount them. This is why a process cartridge bodily replaceable and whose life ends when a developing device runs out of toner has been introduced on the market. This, however, brings about a problem that when the developing device runs out of toner, even the other parts still usable must be wastefully replaced together with the developing device.

On the other hand, Japanese Patent Laid-Open Publication No. 10-239974, for example, discloses an image forming apparatus configured such that a toner container for replenishing toner to a developing device, which is included in a process cartridge, is removably mounted to the process cartridge. The problem with this image forming apparatus is that the toner container cannot be replaced unless the process cartridge is bodily removed from the apparatus body, resulting in inefficient replacement.

The illustrative embodiment solves the above problems by allowing the process cartridges 6Y through 6K and toner bottles 32Y through 32K to be mounted and dismounted from the printer body independently of each other.

Figure 3:
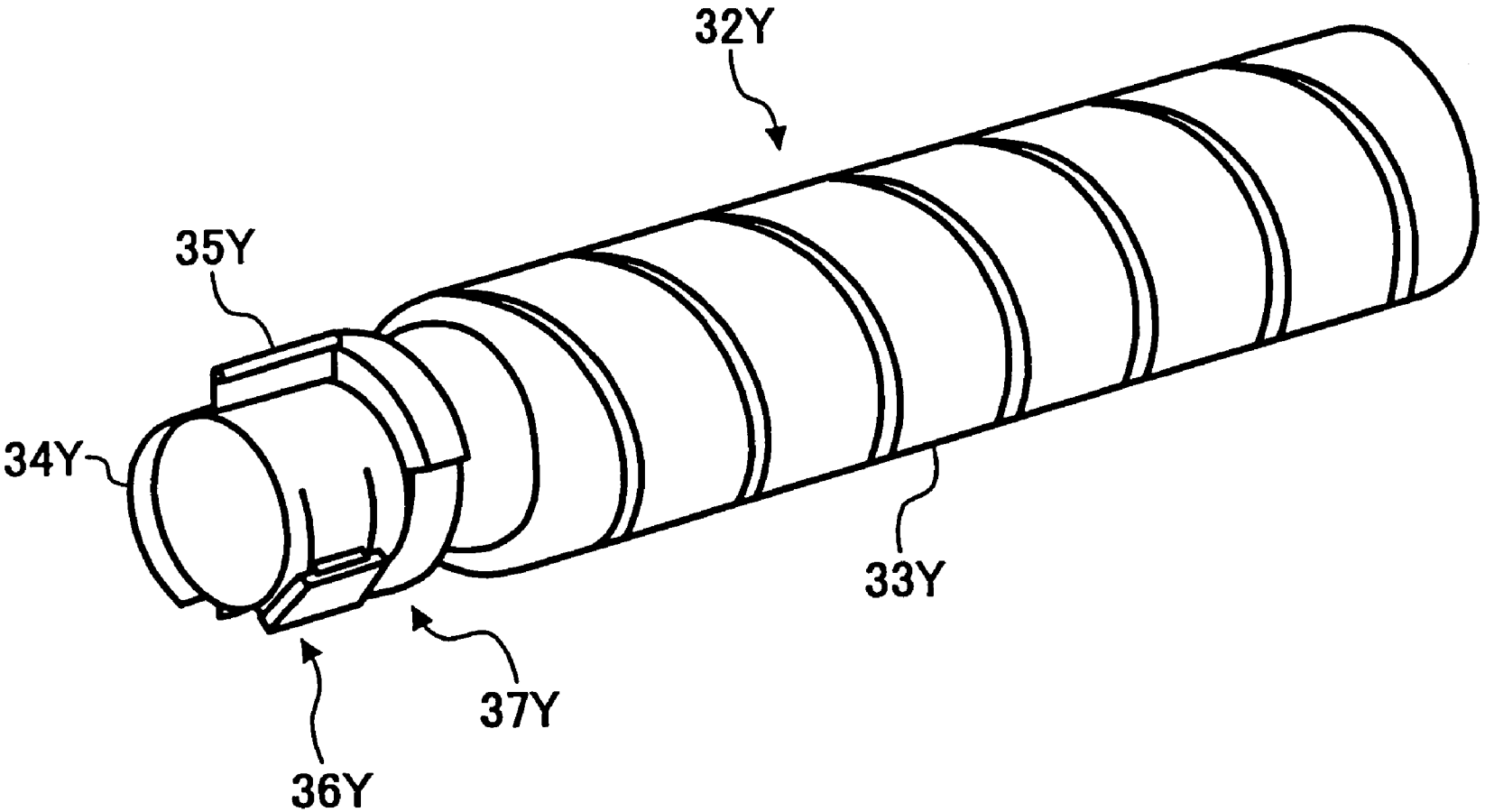
FIG. 3 is an isometric view of a toner bottle applicable to the illustrative embodiment.

FIG. 3 shows the appearance of the Y toner bottle 32Y by way of example. As shown, the toner bottle 32Y is made up of a hollow, cylindrical body 33Y and a cap 34Y affixed to the end of the body 33Y. A spiral, screw-like ridge 38Y (shown in FIG. 5) is formed along the circumferential surface of the body 33Y by embossing and protrudes into the inside of the body 33Y. When the toner bottle 32Y is caused to rotate by the toner conveying device, which will be described later, the Y toner in the body 33Y moves from one end or bottom toward the other end the body 33Y along the spiral ridge 38Y and then enters the cap 34Y. This configuration allows the toner to move in the toner bottle 32Y without resorting to toner conveying means otherwise arranged in the toner bottle 32Y, thereby avoiding an increase in cost ascribable to the toner conveying means. In addition, the toner bottle is successfully reduced in size.

The cap 34Y, slightly smaller in diameter than the body 33Y, is provided with a grip 35Y, a shutter 36Y, and a gear 37Y. The grip 35Y protrudes from the circumference of the cap 34Y and extends in the axial direction of the cap 34Y. The shutter 36Y is slidable in the circumferential direction of the cap 34Y and closes, in the position shown in FIG. 3, a toner outlet, not shown, formed in the circumferential wall of the cap 34Y. The gear 37Y is positioned in a portion adjacent to the body 33Y in the axial direction and where the grip 35Y and shutter 36Y are absent. The gear 37Y is formed with a plurality of gear teeth over its entire circumference although not shown specifically. When the gear teeth 37Y are brought into mesh with a drive gear, not shown, included in the toner conveying device, the toner bottle 32Y is bodily rotated about its axis. This is also true with the other toner bottles 32M through 32K.

Figure 4:
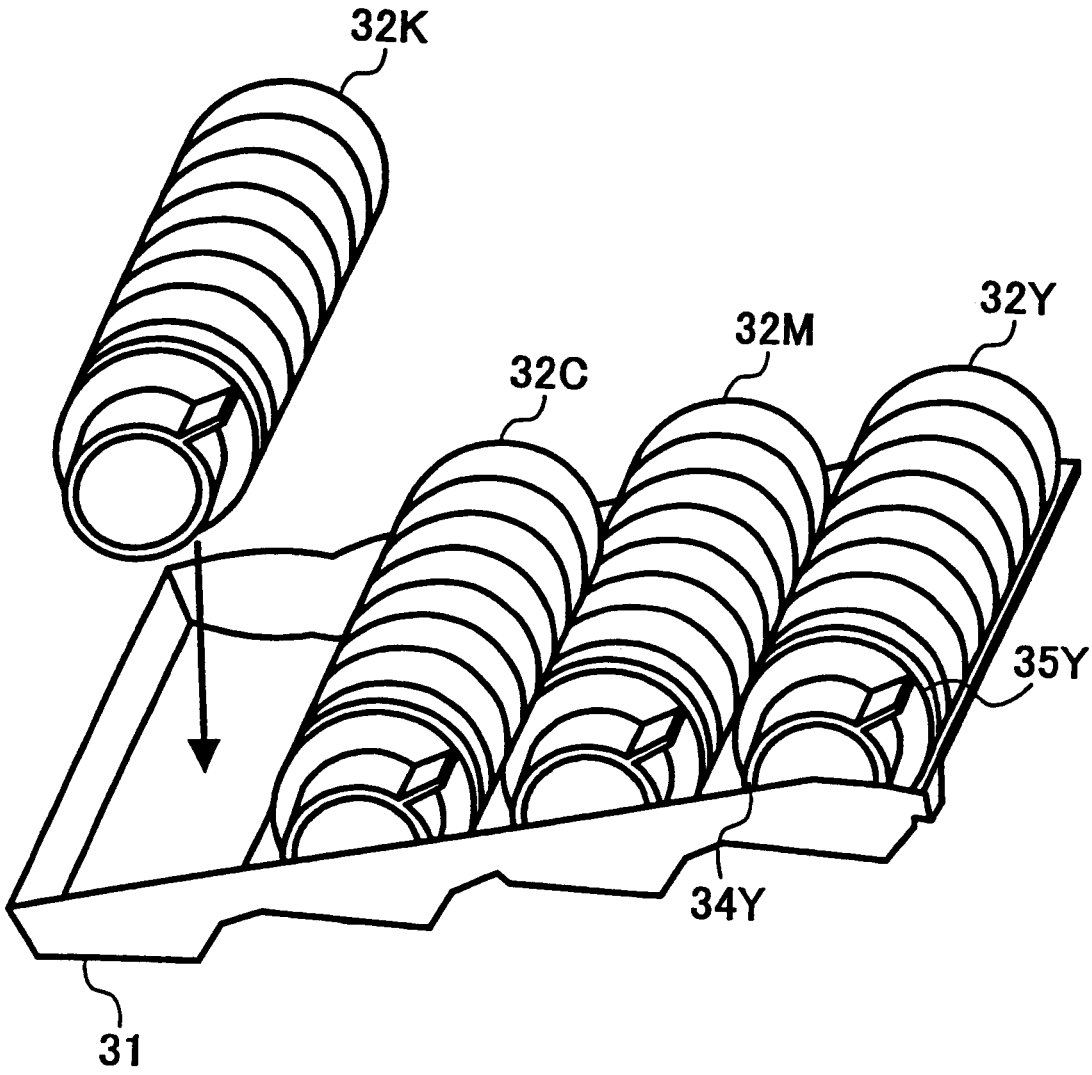
FIG. 4 demonstrates how the toner bottle is mounted to a bottle storage.

FIG. 4 shows the bottle storage 31 and four toner bottles 32Y through 32K. As shown, the bottle storage 31 includes four mount portions for mounting the toner bottles 32Y through 32K, respectively. FIG. 4 shows a specific condition in which the toner bottle 32K is being mounted to a mount portion by way of example. The operator puts the toner bottle 32K on the mount portion and then rotates the toner bottle 32K by holding the grip 35Y. As a result, the shutter 36Y, FIG. 3, opens to expose the toner outlet of the cap 34K, which is oriented vertically downward. At the same time, the cap 34K is fixed in position by a locking portion, not shown, included in the mount portion. This is also true with the other toner bottles 32Y, 32M and 32C.

Figure 5:
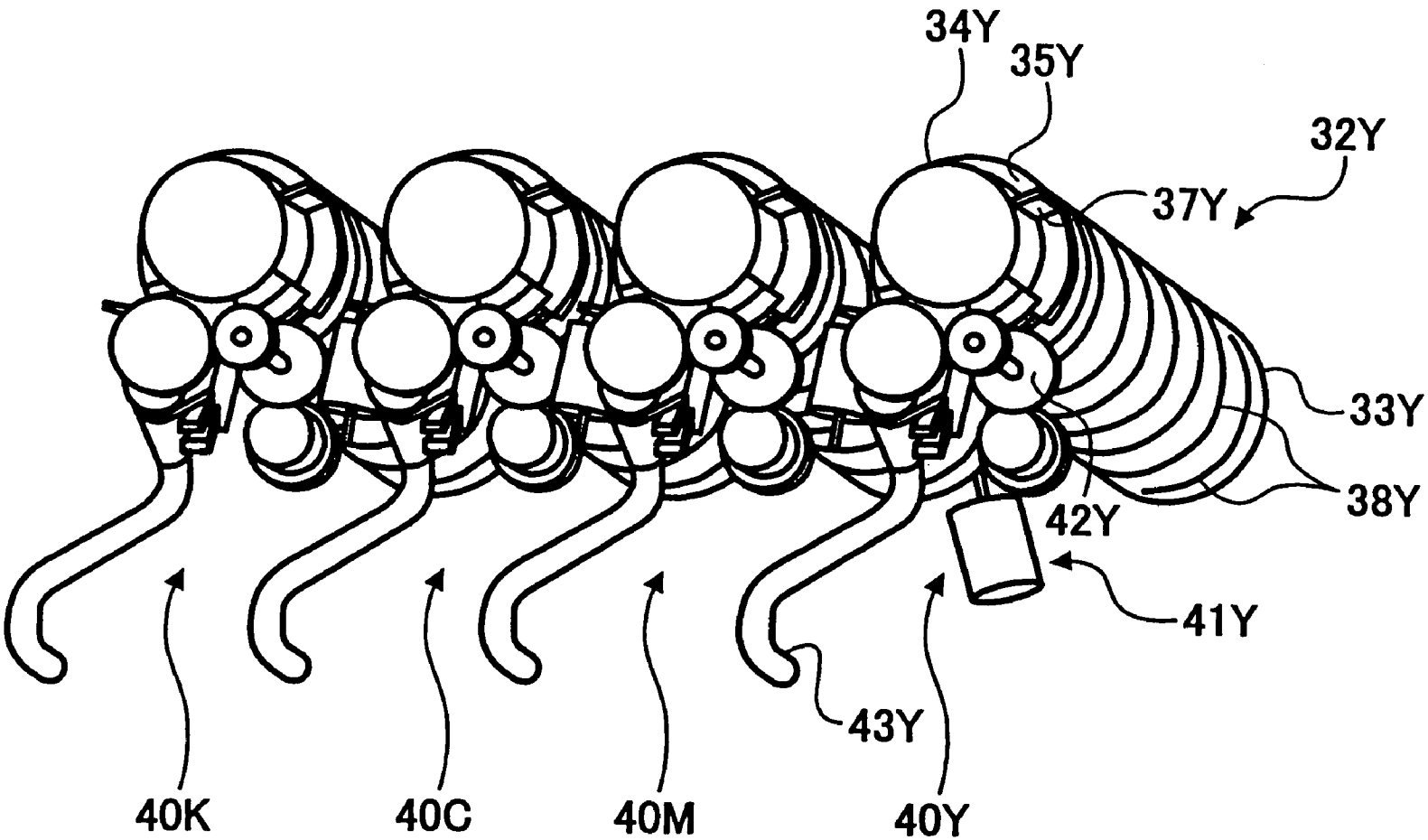
FIG. 5 is an isometric view showing a plurality of toner bottles and a plurality of toner conveying device assigned thereto.

FIG. 5 shows toner conveying devices 40Y through 40K included in the printer 100 and substantially identical in configuration with each other except for the color of toner to deal with. Let the following description concentrate on the toner conveying device 40Y dealing with the Y toner by way of example.

As shown in FIG. 5, the toner conveying device 40Y includes a drive motor 41Y, a drive gear 42Y and a pipe 43Y in addition to the toner bottle 32Y and mount portion 31Y, FIG. 4. When the toner bottle Y is accurately positioned on the mount portion 31Y, the gear 37Y of the cap 34Y is brought into mesh with the drive gear 42Y. Subsequently, when the drive motor 41Y causes the drive gear 42Y to rotate, the rotation of the drive gear 42Y is transmitted to the entire toner bottle 32Y via the gear 37Y, causing the toner bottle 32Y to rotate. As a result, the Y toner drops from the toner bottle 32Y into the pipe 43Y via the toner outlet of the cap 34Y. A coil, not shown, formed of resin is disposed in the pipe 43Y and also rotated by the drive motor 41Y. The coil plays the role of locomotive power exerting means for exerting locomotive power on the Y toner introduced into the pipe 43Y in the lengthwise direction of the pipe 43Y, so that the Y toner is conveyed toward the Y developing device 5Y.

The drive motor 41Y and therefore the replenishment of the Y toner to the Y developing unit 5Y is selectively controlled ON or OFF in accordance with the output voltage of the toner content sensor 56Y stated earlier. Alternatively, for toner content control, use may be made of reference toner images formed in the non-image portions of the drums included in the process cartridges 6Y through 6K and photosensors responsive to the densities of the reference toner images.

Figure 6:
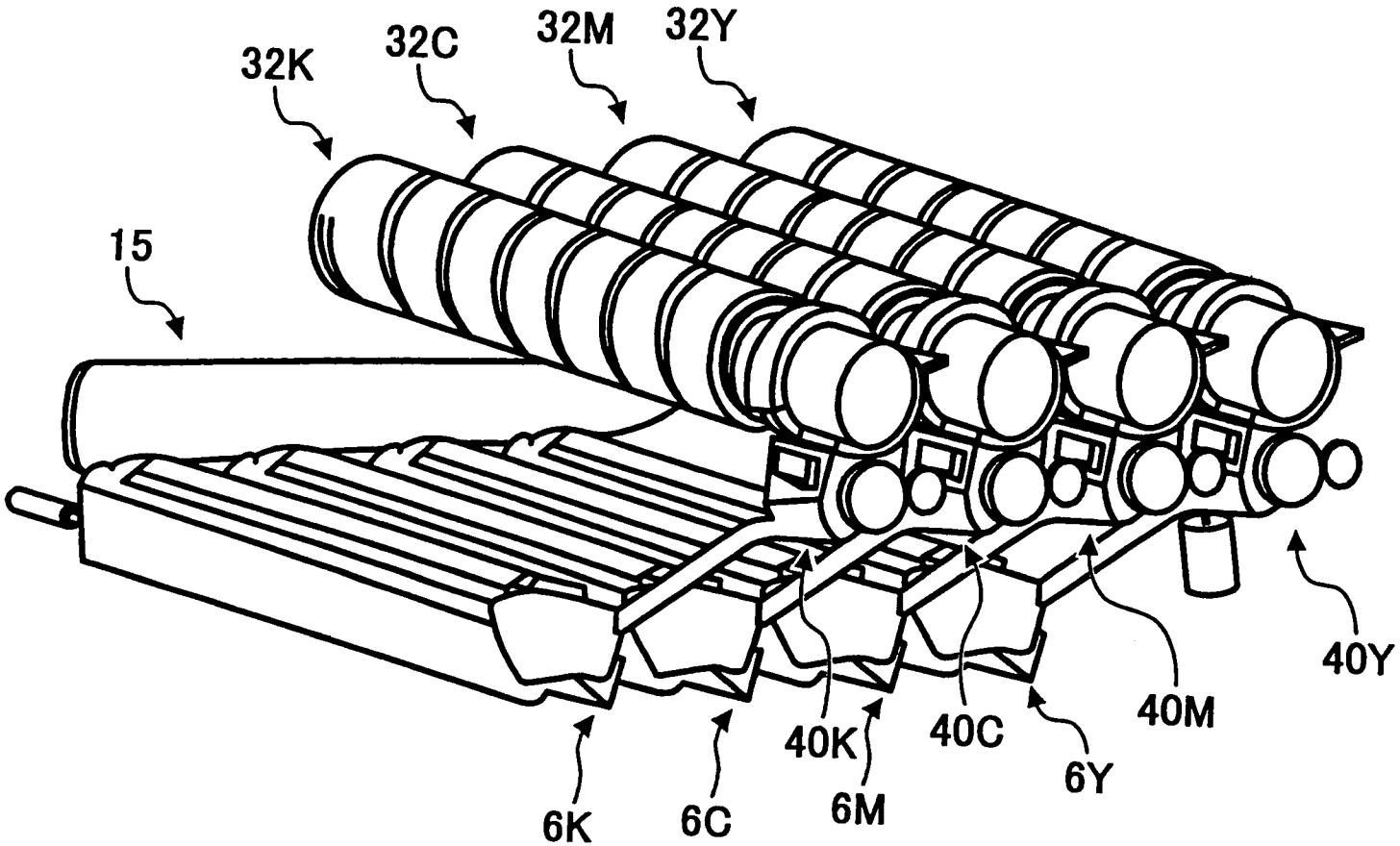
FIG. 6 is an isometric view showing the toner bottles, an intermediate image transferring unit and the toner conveying devices, as seen in a different angle.

FIG. 6 shows the process cartridges 6Y through 6K and part of the toner conveying devices 40Y through 40K. As shown, the process cartridges 6Y through 6K are positioned below the toner bottles 32Y through 32K, respectively, in the direction of gravity. In this configuration, the toners are conveyed from the toner bottles 32Y through 32K to the developing devices of the process cartridges 6Y through 6K positioned below the toner bottles 32Y through 32K. This obviates troubles ascribable to toner conveyance effected against gravity. The toner bottles 32Y through 32K and process cartridges 6Y through 6K are positioned relatively remote from each other while the intermediate image transferring unit 15 is positioned between them.

Figure 7:
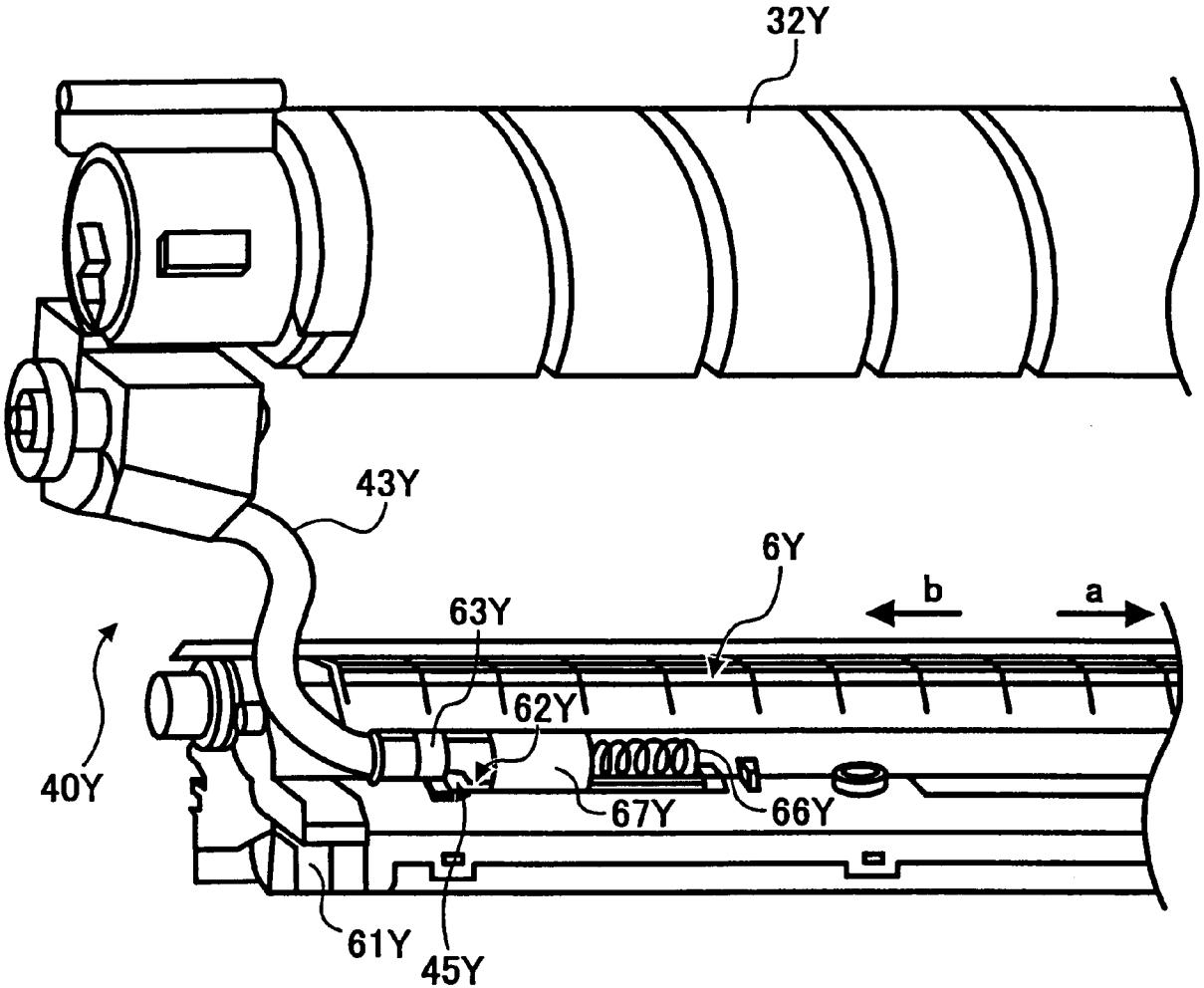
FIG. 7 is an isometric view showing an arrangement for connecting a pipe and the process cartridge.
Figure 8:
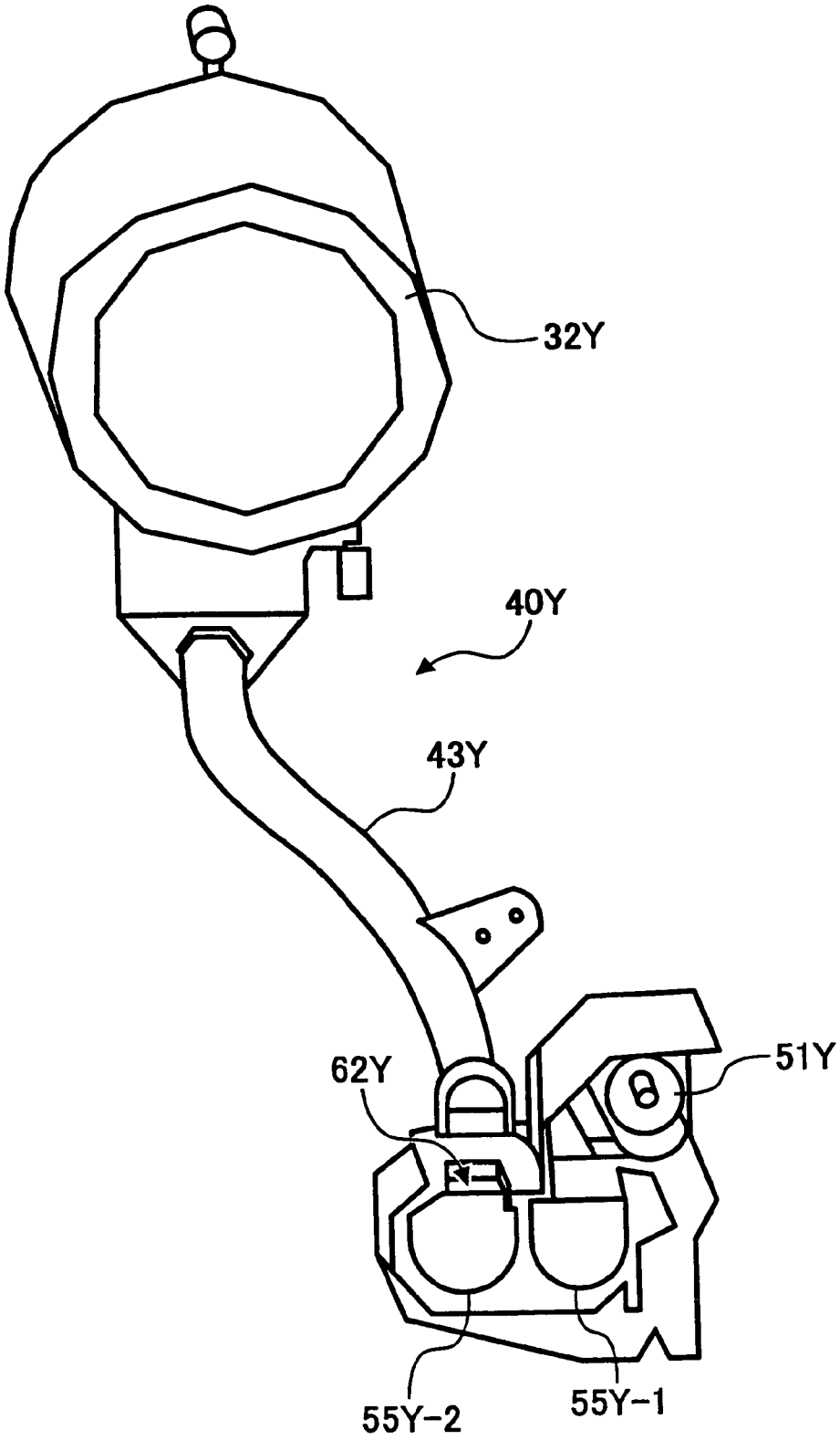
FIG. 8 is an isometric view showing the pipe, as seen in a different angle.
Figure 9:
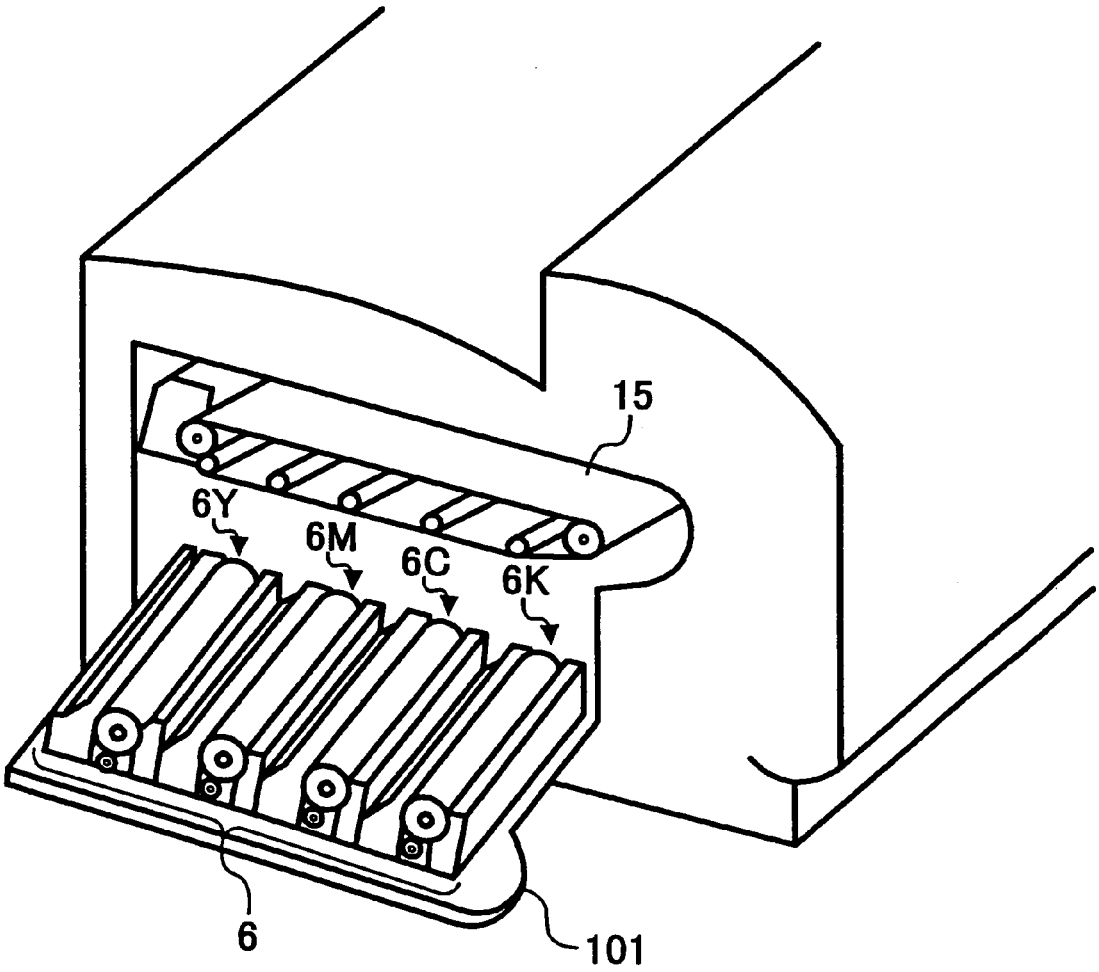
FIG. 9 shows how the process cartridge is pulled out.
Figure 10:
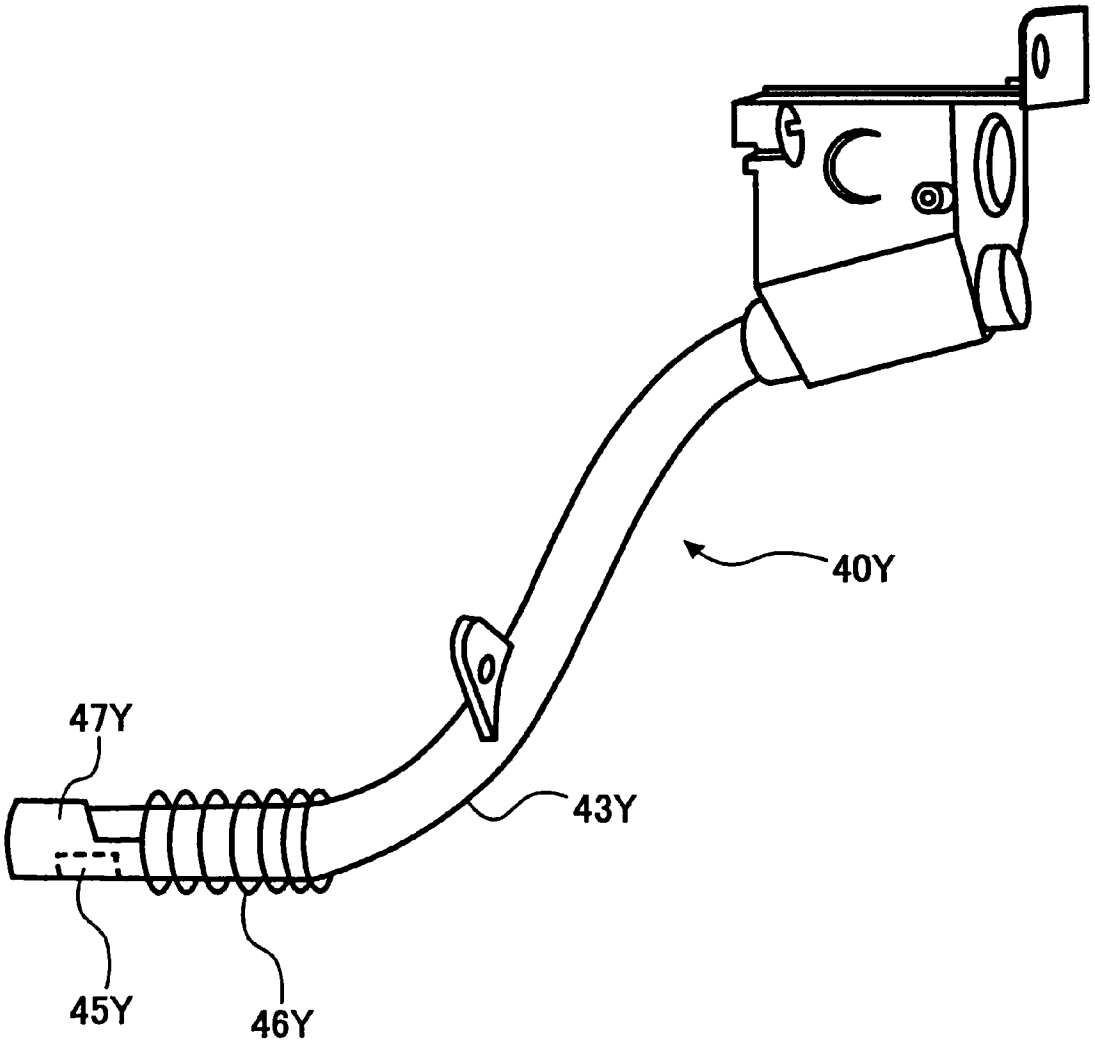
FIGS. 10 and 11 are views showing one of the toner conveying devices assigned to yellow toner.
Figure 12:
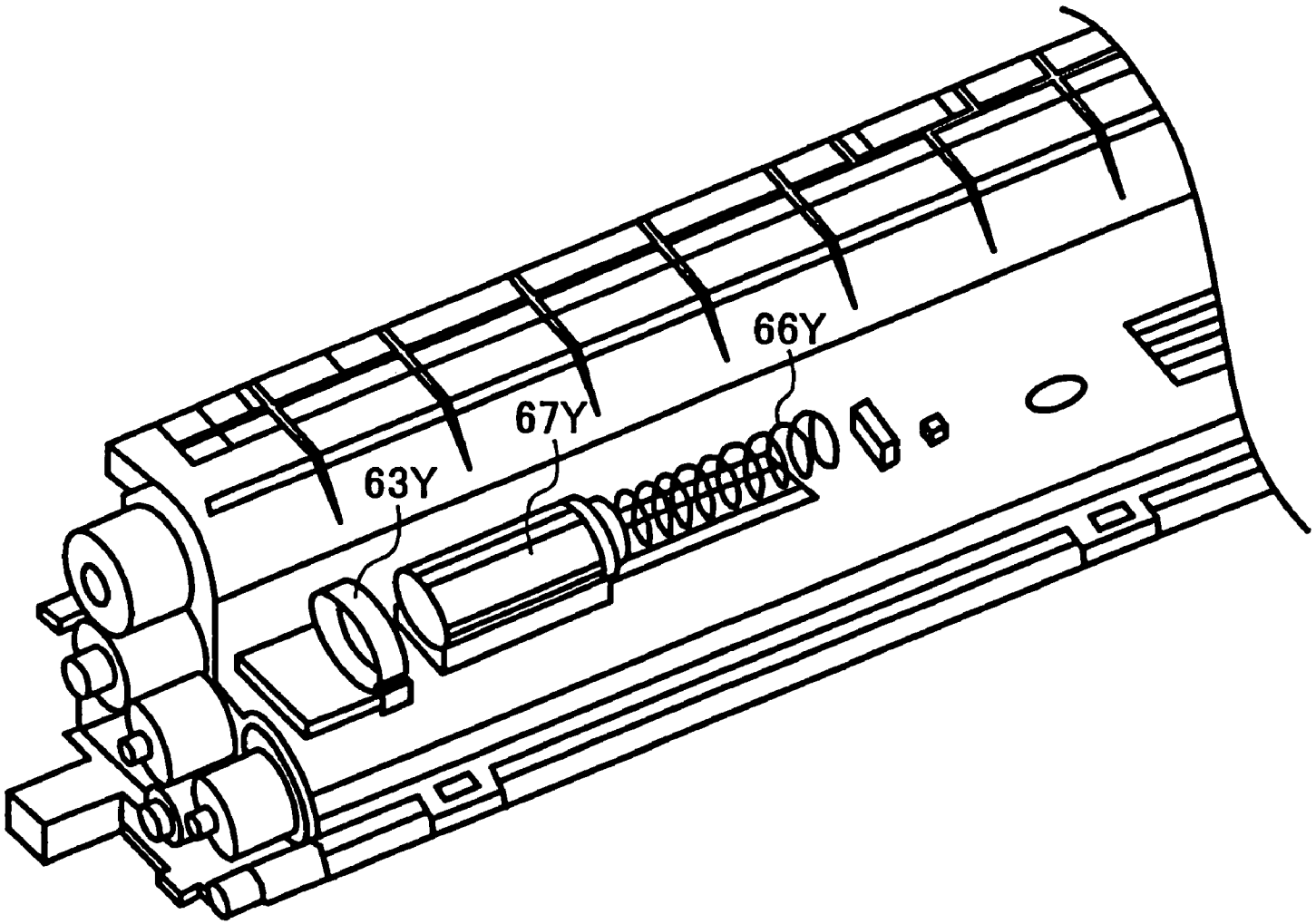
FIGS. 12 and 13 are views showing the process cartridge using yellow toner.
Figure 13:
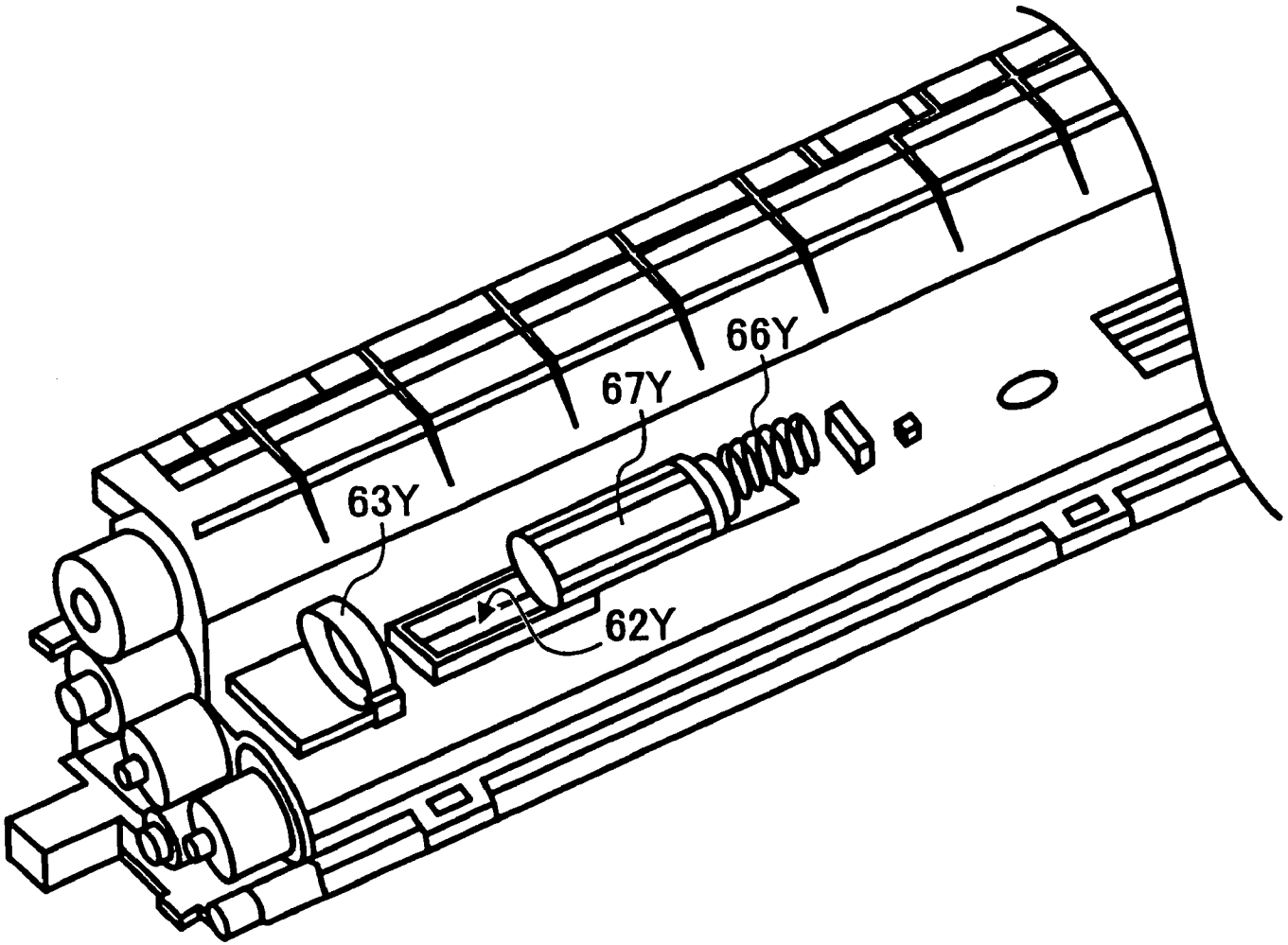

FIG. 7 shows a specific position of a toner replenishing port 62Y formed in the process cartridge 6Y and a specific configuration for establishing communication between the port 62Y and the pipe 43Y. FIG. 8 shows the same configuration, as seen in a different angle FIGS. 9 and 10 show a specific configuration of the toner conveying device 40Y. Further, FIGS. 12 and 13 show a specific arrangement around the toner replenishing port 62Y of the process cartridge 6Y.

The process cartridge 6Y shown in FIG. 7 is positioned at the rear side when mounted to the printer body. A pair of end plates 61Y (only one is shown) are mounted on the axially opposite ends of the process cartridge 6Y and cooperate to support the sleeve 51Y, screws 55Y-1 and 55Y-2 and so forth. The end plates 61Y face each other at a preselected distance from each other. The toner replenishing port 62Y is formed in the upper portion of the developer storing portion 53Y within the above distance. This makes it needless to extend the distance between the end plates 61Y more than necessary for locating the toner replenishing port 62Y. In addition, it is not necessary to locate a toner replenishing region outside of the end plate 61Y, so that the process cartridge 6Y is prevented from becoming bulky.

The specific configuration shown in FIG. 7 is similarly practicable even when the distance between the end plates 61Y, which support the end portions of the various components of the process cartridge 6Y is locally different. The crux is that the toner replenishing port 62Y be positioned within the preselected distance between the end plates 61Y.

The toner replenishing port 62Y is positioned at a lower level or height than the top of the sleeve 51Y. The end of the pipe 43Y is positioned above the toner replenishing port 62Y while an opening 45Y, which faces the toner replenishing port 62Y, is formed in the bottom of the pipe 43Y. The end of the pipe 43Y constitutes a tubular engaging portion to be engaged with the process cartridge 6Y. More specifically, the end of the pipe 43Y is slidable in parallel to the direction in which the process cartridge 6Y is mounted to or dismounted from the printer body. After the process cartridge 6Y has been inserted into the printer body in a direction indicated by an arrow b in FIG. 7, the process cartridge 6Y is stopped when the toner replenishing portion 62Y faces the opening 45Y of the pipe 43Y.

As shown in FIG. 7, a support ring or ring-like support 63Y may be mounted on the upper portion of the process cartridge 6Y and sized to receive the end of the pipe 43Y. In this case, when the pipe is connected to the process cartridge 6Y, the end of the pipe 43Y is received in the support ring 63Y. When the process cartridge 6Y is dismounted from the printer body in a direction indicated by an arrow a, the pipe 43Y is released from the support ring 63Y.

Further, a shutter 47Y is disposed in the opening 45Y of the pipe 43Y while a shutter 67Y is disposed in the toner replenishing port 62Y of the process cartridge 6Y. The shutters 47Y and 67Y each are configured to open or close when the process cartridge 6Y is mounted to or dismounted from the printer body, respectively.

First, how the process cartridge 6Y is mounted to or dismounted from the printer will be described. To pull out the process cartridge 6Y from the position shown in FIG. 1, a person opens a front cover 101 mounted on the front of the printer body and then pulls the-process cartridge forward. A guide member, not shown, is mounted on the printer body for allowing the process cartridge 6Y to slide into or out of the printer body. When the person starts pulling out the process cartridge 6, the guide members guide the end of the drum to a retracted position. As the person further pulls out the process cartridge 6, the end of the drum is released from the guide member. As a result, as shown in FIG. 9, the process cartridge 6 is removed via an opening formed in the front of the printer body. To mount the process cartridge 6, the person inserts the process cartridge 6 into the printer body until the process cartridge 6 has been stopped, and then closes the front cover 101.

A specific configuration for causing the shutters 47Y and 67Y to open and close will be described hereinafter. FIGS. 10 and 12 respectively show the toner conveying device 43Y and process cartridge 6Y in a condition wherein the process cartridge 6Y is not mounted to the printer body. As shown, the shutter 47Y of the pipe 43Y, constantly biased by a spring 46Y, closes the opening 45Y while the shutter 67Y of the process cartridge 6Y, constantly biased by a spring 66Y, closes the toner replenishing port 62Y.

Figure 11:
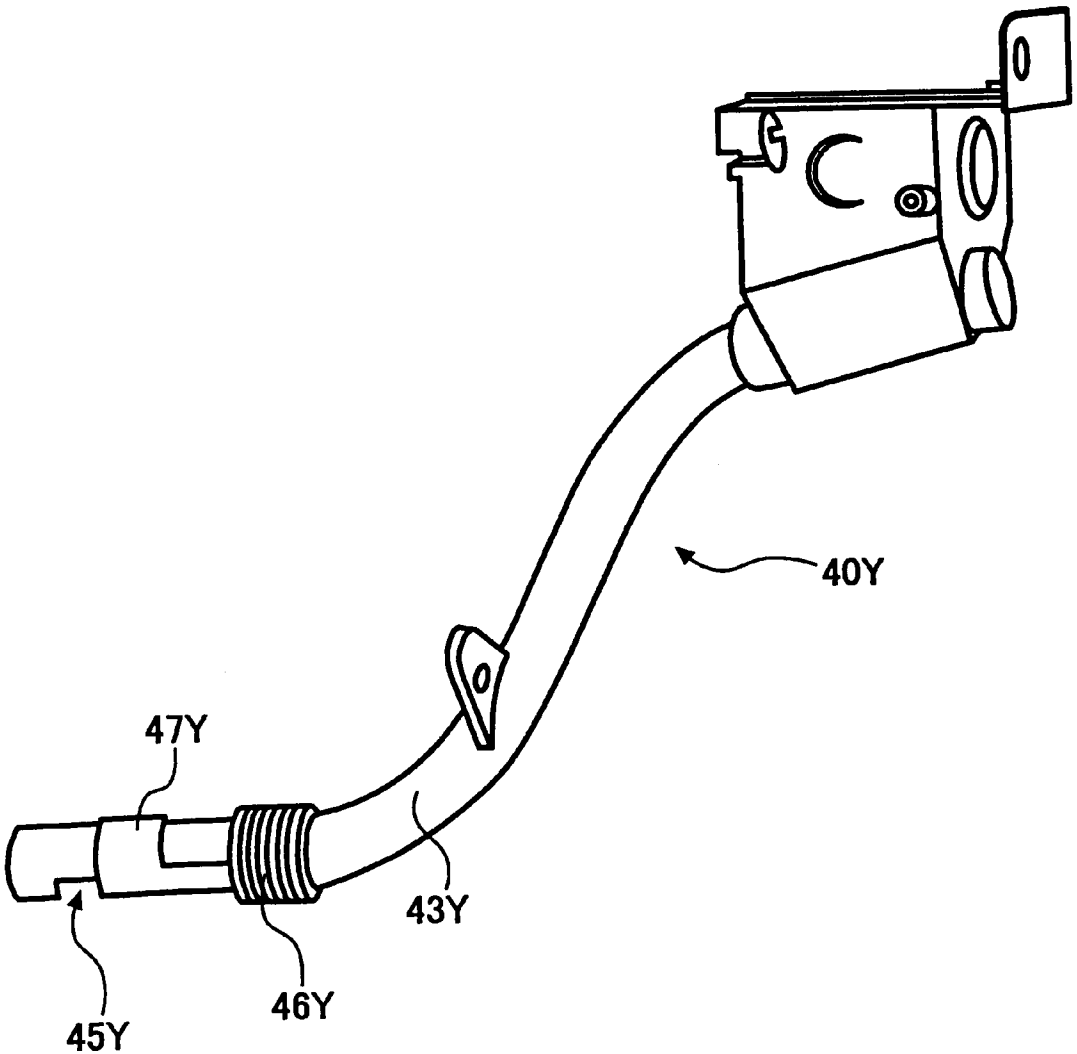

When the process cartridge 6Y is slid into the printer body, the support ring 63Y is coupled over the pipe 43Y. At this instant, because the shutter 47Y cannot be passed through the support ring 63Y and is therefore stopped by the support ring 63Y, compressing the spring 66Y. As a result, as shown in FIG. 11, the shutter 47Y is slid to uncover the opening 45Y. At the same time, as the process cartridge 47 is further slid into the printer body, the end of the pipe 43Y passed through the support ring 63Y presses the shutter 67Y of the process cartridge 6Y, compressing the spring 66Y. Consequently, the shutter 67Y is slid to uncover the toner replenishing port 62Y. Finally, the process cartridge 6Y is stopped at the preselected position shown in FIG 7, so that the opening 45Y and toner replenishing port 62Y are brought into communication with each other. A seal member is located at a position where the two openings 45Y and 62Y face each other in order to prevent toner from leaking.

On the other hand, when a person pulls out the process cartridge 6Y from the printer body in the condition shown in FIG. 7, the spring 66Y, compressed by the pipe 43Y, springs back and forces the shutter 67Y toward the rear of the printer body. As a result, the shutter 67Y is moved in the direction b to again cover the toner replenishing port 62Y, so that the condition shown in FIG. 12 is restored. At the same time, the pipe 43Y is released from the support ring 63Y of the process cartridge 6Y with the result that the spring 46Y, compressed by the support ring 63Y, springs back while forcing the shutter 47Y toward the end of the pipe 43Y. Consequently, the shutter 47Y, moving in the direction a, again closes the opening 45Y, so that the condition shown in FIG. 10 is restored.

Figure 14:
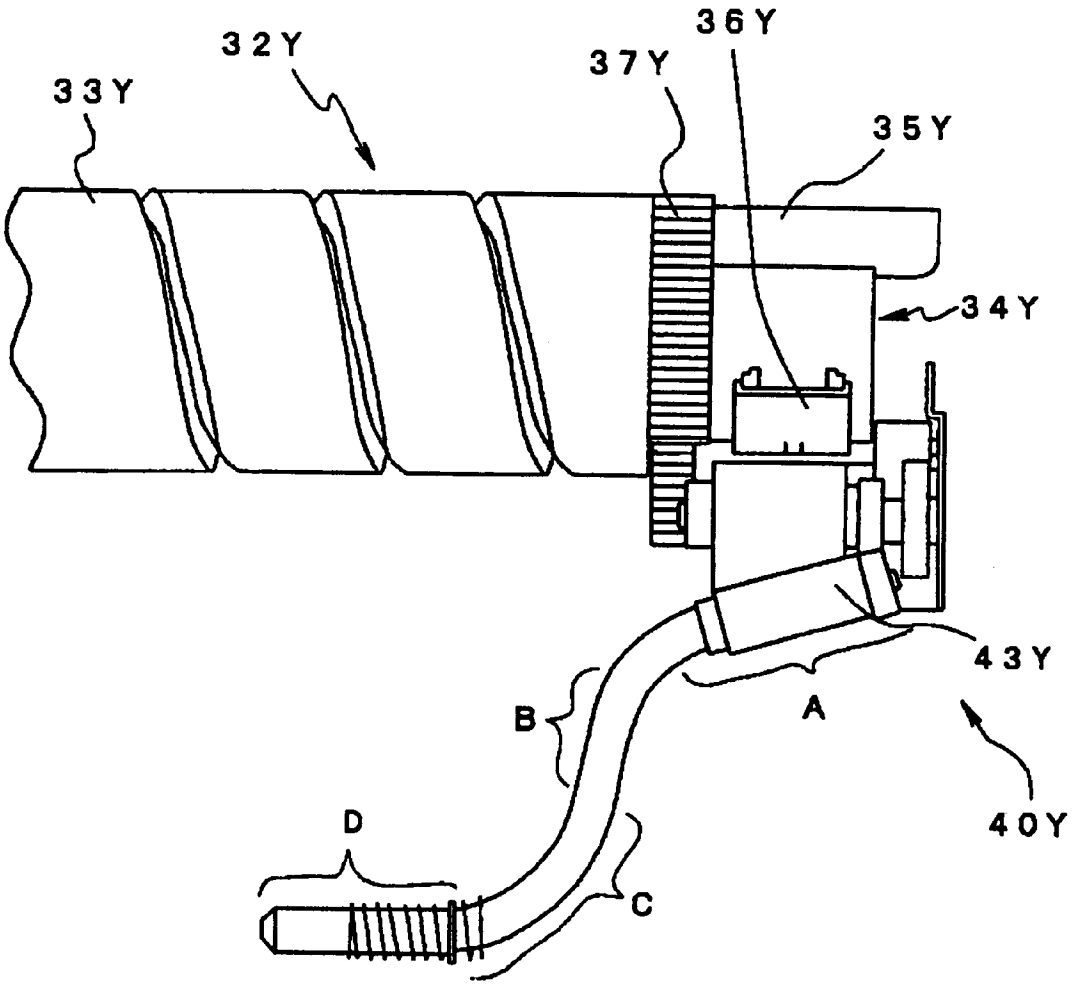
FIG. 14 is a view showing part of the yellow toner conveying device.

Hereinafter will be described arrangements unique to the illustrative embodiment. FIG. 14 shows part of the toner conveying device 40Y. As shown, the Y toner, discharged from the toner bottle 32Y via the toner outlet of the cap 34Y, is introduced into the pipe 43Y. The pipe 43Y includes an inlet portion A for receiving the Y toner, a straight portion B extending downward toward the developing device, and a bent portion C bent with an angle smaller than the linear portion B relative to the horizontal. The pipe 43Y additionally includes a connecting portion D connected to the developing device. It will be seen that the bent portion C provides the connecting portion D downstream of the bent portion C with an angle far smaller than the straight portion B relative to the horizontal. Therefore, although the Y toner may rush in the straight portion B toward the developing device in the direction of gravity, it is slowed down in the bent portion C before reaching the developing device.

In the configuration described above, the flow of the Y toner can be slowed down before reaching the developing device despite that the pipe 43Y is long enough to allow the intermediate image transferring unit 15 to intervene between the toner bottle 32Y and the process cartridge 6Y. This obviates troubles ascribable to the rush of the Y toner into the developing device of the process cartridge 6Y. Further, the pipe 43Y, which is relatively long, makes it possible to arrange the toner bottle 32Y and process cartridge 6Y remotely from each other, promoting free layout. The configuration shown in FIG. 14 applies to the other toner conveying devices 40M, 40C and 40K also.

Figure 15:
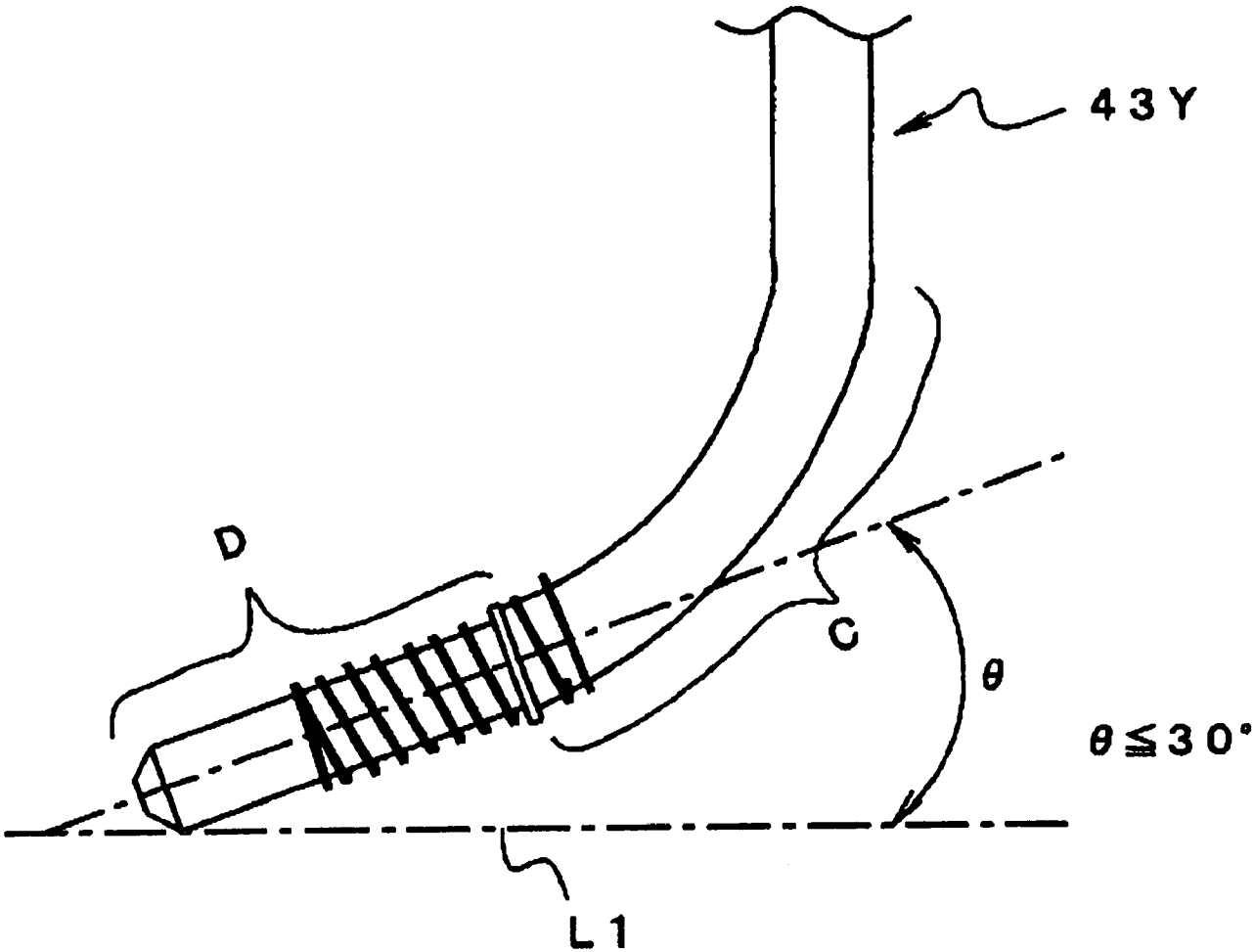
FIG. 15 is a view showing part of the pipe included in the Y toner conveying device.

As shown in FIG. 15, in the illustrative embodiment, the connecting portion D downstream of the bent portion C is inclined by an angle θ of 30° or less relative to the horizontal L1. This is because experiments showed that when the angle was 30° or less, the rush of the Y toner into the developing device could be surely obviated.

Figure 16:
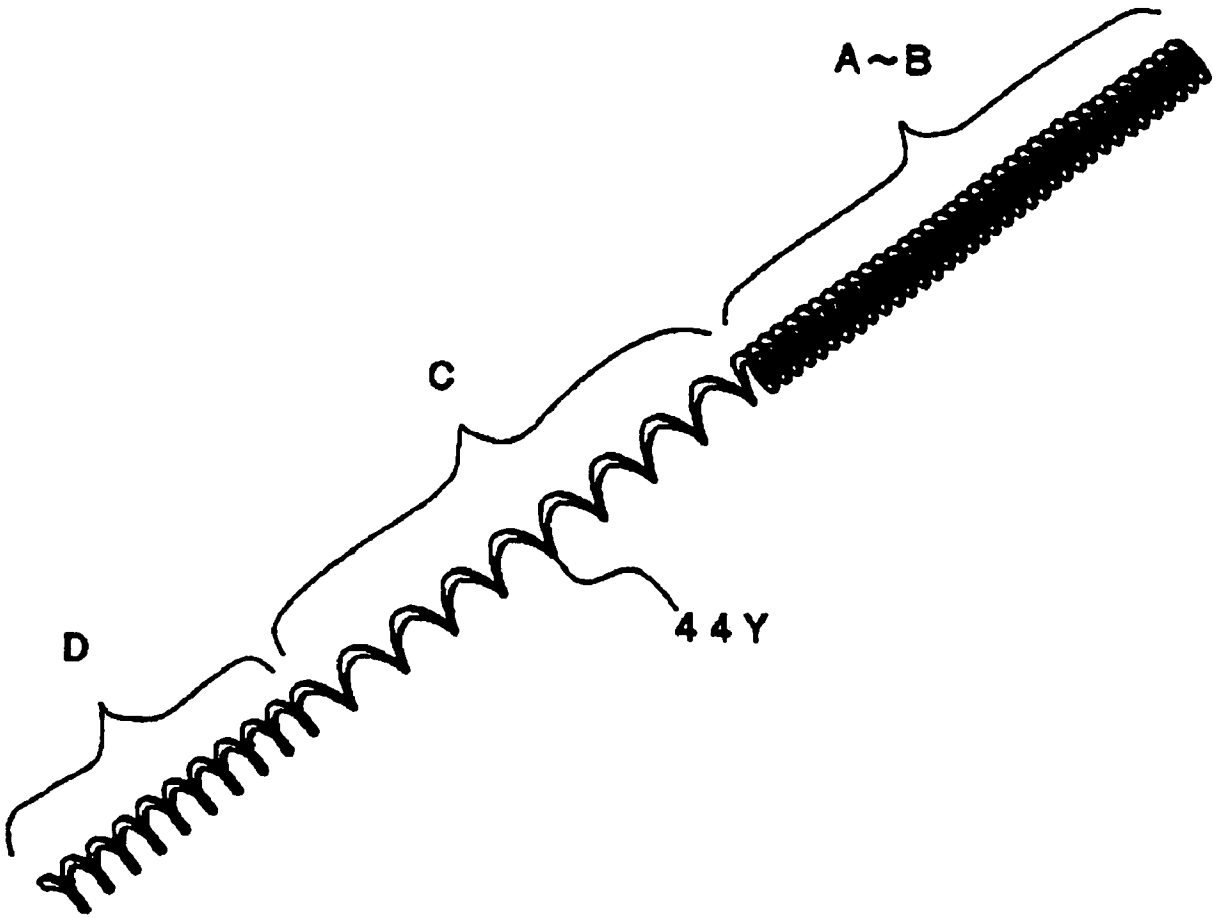
FIG. 16 is a view showing a coil disposed in the pipe.

FIG. 16 shows a specific configuration of a coil 44Y disposed in the pipe 43Y not shown. When the coil 44Y is rotated, it exerts locomotive power on the Y toner toward the developing device, thereby further insuring the conveyance of the toner in the pipe 43Y.

The ability of the coil 44Y or similar locomotive power exerting means should preferably be varied at least between the bent portion C and the straight portions A, B and D in accordance with the property of the toner relating to staying, wear and so forth. For example, the toner is apt to stay and therefor form lumps more in the bent portion C than in the straight portions. Therefore, in the case where the lumps of toner are conspicuous in the bent portion C, the locomotive power exerting ability of the coil 44Y may be made higher in the bent portion C than in the straight portions so as to reduce the lumps.

On the other hand, it is likely that the toner is deteriorated in the bent portion C because greater friction occurs between the inner wall of the pipe and the toner than in the other portions. Particularly, in the illustrative embodiment using the coil 44Y, friction between the coil 44Y and the inner wall of the pipe also increases and aggravates the wear of the toner. Therefore, in the case where the deterioration of the toner ascribable to friction in the bent portion C is noticeable, the ability of the coil 44Y in the bent portion C may be made lower than in the other portions conversely to the case wherein the lumps are noticeable. It was experimentally found that the deterioration of toner ascribable to friction was more noticeable than the deterioration ascribable to the lumps. In light of this, as shown in FIG. 16, the pitch of the coil 44Y is made larger in the bent portion C than in the other portions to thereby make the locomotive power exerting ability lower in the former than in the latter.

Figure 17:
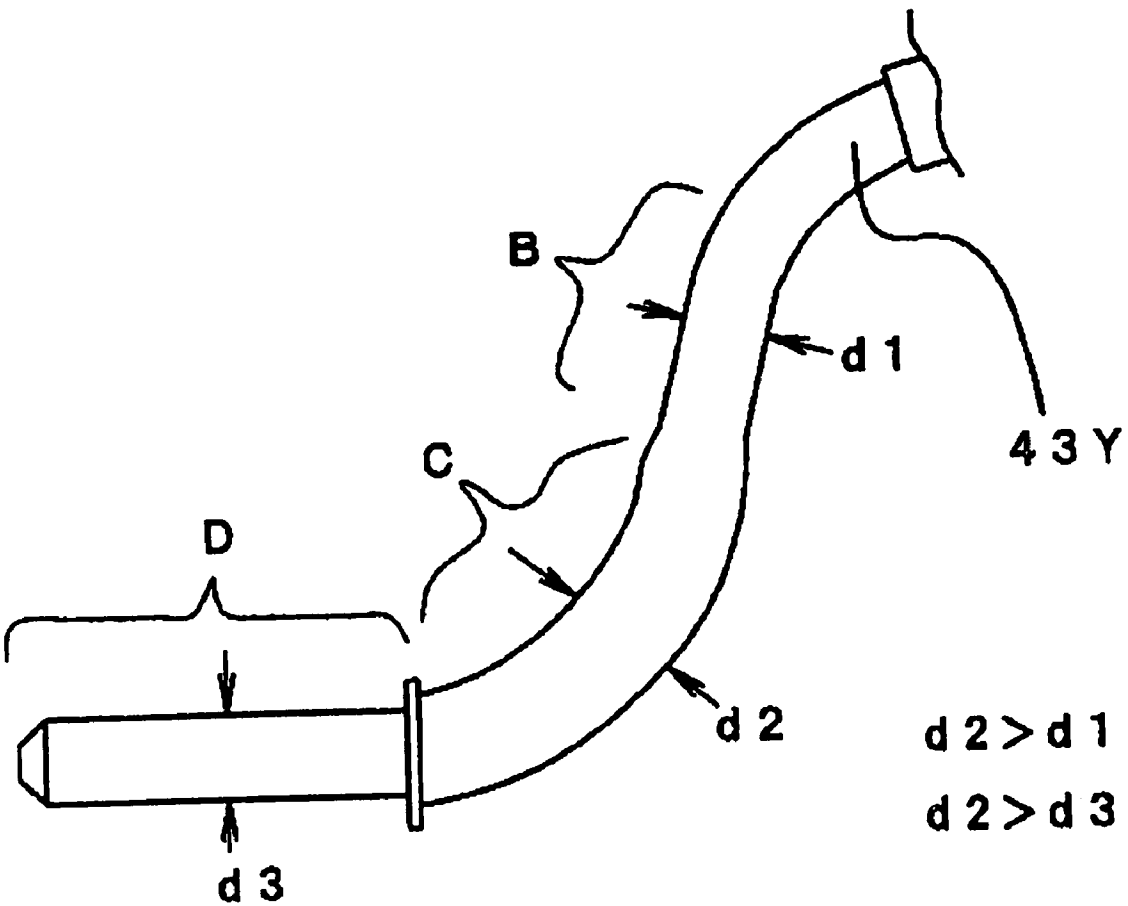
FIG. 17 is a side elevation showing part of the pipe.

Further, in the illustrative embodiment, the inside diameter of the bent portion C should preferably be larger than the inside diameters of the other portions A, B and D in order to prevent the toner from stopping up the bent portion C. In addition, by increasing the diameter of the belt portion C, it is possible to reduce friction between the coil 44Y and the inner wall of the bent portion C for thereby reducing the wear of the toner. For these reasons, as shown in FIG. 17, the bent portion C is provided with an inside diameter d2 larger than the inside diameters d1 and d3 of the straight portion B and connecting portion D, respectively.

While the illustrative embodiment has been shown and described in relation to an electrophotographic printer, the illustrative embodiment is similarly applicable to any other type of image forming apparatus, e.g., a direct recording type of image forming apparatus. A direct recording type of image forming apparatus causes a toner jetting device to jet toner in the form of dots toward a recording medium or an intermediate image transfer body, thereby directly forming a toner image on the recording medium or the intermediate image transfer body. The printer of the illustrative embodiment is practicable not only with toner but also with any other powder.

In summary, it will be seen that the present invention provides a powder conveying device and an image forming apparatus having various unprecedented advantages, as enumerated below.

(1) Powder is conveyed from a powder storing portion to a destination positioned below the powder storing portion, so that troubles ascribable to conveyance against gravity are obviated.

(2) Even when the powder is caused to rush from the powder storing portion toward the destination via a pipe, the powder is slowed down at the bent portion of the pipe upstream of the destination. It follows that the rushing of the powder to the destination can be obviated even if the pipe is relatively long.

(3) The pipe with such a length allows the powder storing portion and destination to be positioned remotely from each other, promoting free layout.

Various modifications will become possible for those skilled in the art after receiving the teachings of the present disclosure without departing from the scope thereof.

What is claimed is:

1. A powder conveying device comprising:

a rotatable bottle configured to convey powder via rotation of the rotatable bottle; and a pipe configured to guide the powder from said rotatable bottle to a destination positioned below said rotatable bottle;

wherein said pipe extends downward from said rotatable bottle toward the destination, then bends with an inclination angle smaller than a preceding inclination angle relative to a horizontal, and then connects to said destination.

2. The device as claimed in claim 1, wherein the inclination angle is 30° or less in a portion following a bent portion of said pipe.

3. A powder conveying device comprising:

a powder storing portion configured to store powder; and a pipe, including a closeable shutter, configured to guide the powder from said powder storing portion to a destination positioned below said powder storing portion;

wherein said pipe extends downward from said powder storing portion toward the destination, then bends with an inclination angle smaller than a preceding inclination angle relative to a horizontal, and then connects to said destination, wherein a bent portion of said pipe has a larger inside diameter than other portions of said pipe not bent.

4. A powder conveying device comprising:

a powder storing portion configured to store powder; and a pipe configured to guide the powder from said powder storing portion to a destination positioned below said powder storing portion;

wherein said pipe extends downward from said powder storing portion toward the destination, then bends with an inclination angle smaller than a preceding inclination angle relative to a horizontal, and then connects to said destination, further comprising locomotive force exciting means disposed in said pipe for exerting locomotive power on the powder present in said pipe toward the destination, wherein said locomotive power exerting means has a locomotive power exerting ability different from a bent portion of said pipe to other portions of said pipe not bent.

5. The device as claimed in claim 4, wherein the bent portion has a larger inside diameter than the other portions.

6. A powder conveying device comprising:

a powder storing portion configured to store powder; and a pipe configured to guide the powder from said powder storing portion to a destination positioned below said powder storing portion;

wherein said pipe extends downward from said powder storing portion toward the destination, then bends with an inclination angle smaller than a preceding inclination angle relative to a horizontal, and then connects to said destination, further comprising a coil disposed in said pipe for exerting locomotive power on the powder present in said pipe toward the destination, wherein said coil has a locomotive power exerting ability different from a bent portion of said pipe to other portions of said pipe not bent.

7. The device as claimed in claim 6, wherein the bent portion has a larger inside diameter than the other portions.

8. An image forming apparatus comprising:

toner image forming means for forming a toner image with powdery toner; and a toner conveying device configured to convey toner from a rotatable bottle to said toner image forming means;

said toner conveying device comprising:

a rotatable bottle configured to store toner and configured to convey toner via rotation of the rotatable bottle; and a pipe configured to guide the toner from said rotatable bottle to a destination positioned below said rotatable bottle;

wherein said pipe extends downward from said rotatable bottle toward said toner image forming means, then bends with an inclination angle smaller than a preceding inclination angle relative to a horizontal, and then connects to said toner image forming means.

9. The apparatus as claimed in claim 8, wherein said toner image forming means includes at least an image carrier configured to form a latent image thereon and a developing device configured to develop said latent image, which are constructed into a single unit removably mounted to a body of the apparatus, and wherein said rotatable bottle is removable from said body independently of said unit.

10. The device as claimed in claim 8, wherein the inclination angle is 30° or less in a portion following a bent portion of said pipe.

11. An image forming apparatus comprising:

toner image forming means for forming a toner image with powdery toner; and a toner conveying device configured to convey toner from a toner storing portion to said toner image forming means;

said toner conveying device comprising:

a toner storing portion configured to store toner; and a pipe, including a closeable shutter, configured to guide the toner from said toner storing portion to a destination positioned below said toner storing portion;

wherein said pipe extends downward from said toner storing portion toward said toner image forming means, then bends with an inclination angle smaller than a preceding inclination angle relative to a horizontal, and then connects to said toner image forming means, wherein a bent portion of said pipe has a larger inside diameter than other portions of said pipe not bent.

12. An image forming apparatus comprising:

toner image forming means for forming a toner image with powdery toner; and a toner conveying device configured to convey toner from a toner storing portion to said toner image forming means;

said toner conveying device comprising:

a toner storing portion configured to store toner; and a pipe configured to guide the toner from said toner storing portion to a destination positioned below said toner storing portion;

wherein said pipe extends downward from said toner storing portion toward said toner image forming means, then bends with an inclination angle smaller than a preceding inclination angle relative to a horizontal, and then connects to said toner image forming means, further comprising locomotive force exerting means disposed in said pipe for exerting locomotive power on the toner present in said pipe toward said image forming means, wherein said locomotive power exerting means has a locomotive power exerting ability different from a bent portion of said pipe to other portions of said pipe not bent.

13. The apparatus as claimed in claim 12, wherein the bent portion has a larger inside diameter than the other portions.

14. An image forming apparatus comprising:

toner image forming means for forming a toner image with powdery toner; and a toner conveying device configured to convey toner from a toner storing portion to said toner image forming means;

said toner conveying device comprising:

a toner storing portion configured to store toner; and a pipe configured to guide the toner from said toner storing portion to a destination positioned below said toner storing portion;

wherein said pipe extends downward from said toner storing portion toward said toner image forming means, then bends with an inclination angle smaller than a preceding inclination angle relative to a horizontal, and then connects to said toner image forming means, wherein the inclination angle is 30° or less in a portion following a bent portion of said pipe, further comprising locomotive force exerting means disposed in said pipe for exerting locomotive power on the toner present in said pipe toward said image forming means, wherein said locomotive power exerting means has a locomotive power exerting ability different from a bent portion of said pipe to other portions of said pipe not bent.

15. The apparatus as claimed in claim 14, wherein the bent portion has a larger inside diameter than the other portions.

16. A powder conveying device comprising:

a powder storing portion storing powder; and a pipe, including a closeable shutter, configured to guide the powder from said powder storing portion to a toner replenishing port positioned below said powder storing portion and on an upper portion of a process cartridge;

wherein said pipe extends downward from said powder storing portion toward the replenishing port, then bends with an inclination angle smaller than a preceding inclination angle relative to a horizontal, and then connects to said replenishing port.

* * * * *